United States Patent [19]

Marsilio

[11] 3,993,881

[45] Nov. 23, 1976

[54] SNAP-ACTION SLIDE SWITCH

[75] Inventor: Dominic O. Marsilio, Flourtown, Pa.

[73] Assignee: Continental-Wirt Electronics Corporation, Warminster, Pa.

[22] Filed: Nov. 5, 1975

[21] Appl. No.: 628,883

[52] U.S. Cl. ..... 200/76; 200/339

[51] Int. Cl.[2] ..... H01H 15/18

[58] Field of Search ..... 200/67 G, 67 A, 67 R, 200/330, 339; 29/622

[56] References Cited

UNITED STATES PATENTS

| | | | |
|---|---|---|---|
| 3,217,112 | 11/1965 | Campbell et al. | 200/339 |
| 3,737,601 | 6/1973 | Arthur et al. | 200/76 |

*Primary Examiner*—David Smith, Jr.
*Attorney, Agent, or Firm*—Edelson and Udell

[57] ABSTRACT

A slide switch designed for snap action operation thereof having a pivoted rocker arm engaging flexible elements of the insulated slide member of the switch. These flexible elements are formed of material, preferably such as moldable plastic, which has the inherent elastical power of recovering its initially produced durable shape when a deforming force or pressure causing it to be temporarily deformed is removed. The insulated slide member is provided with upwardly projecting lugs which embrace therebetween the pivoted lever arm by which they are outwardly deflected to store up energy for the snap action of the switch. While the free end of the pivoted lever arm is preferably bifurcated to provide it with flexible extremities which are flexed inwardly simultaneously as the slide lugs are outwardly deflected whereby to augment the snap actuating energy stored up by the flexed lugs of the slide member, the lever arm may be formed as a solid member so that the requisite energy is obtained solely by the flexure of the slide lugs.

15 Claims, 6 Drawing Figures

FIG. 1
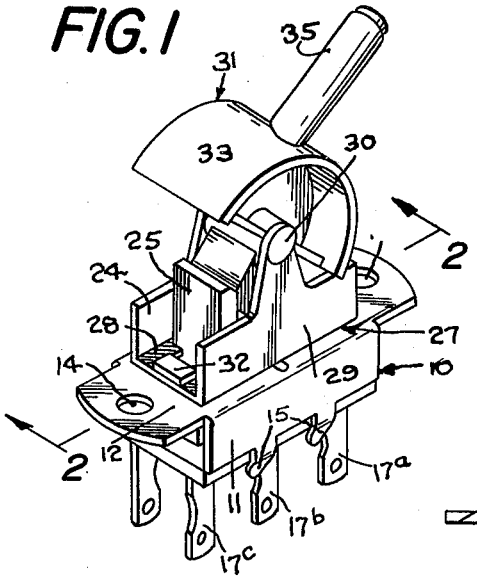
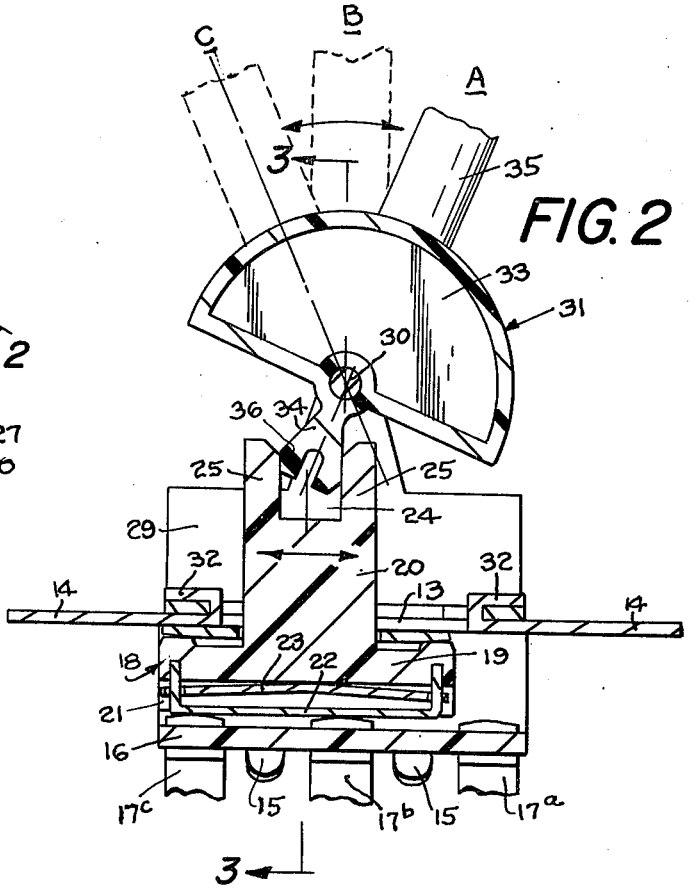
FIG. 2
FIG. 3
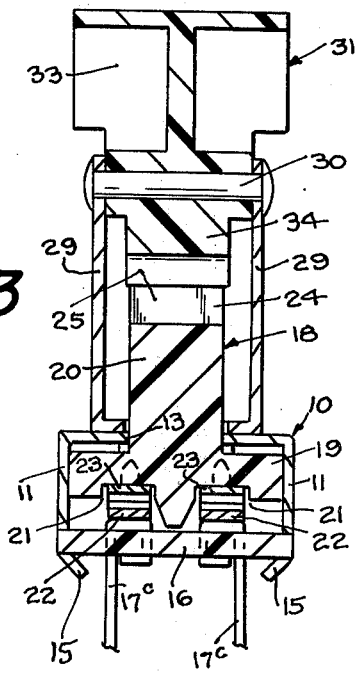
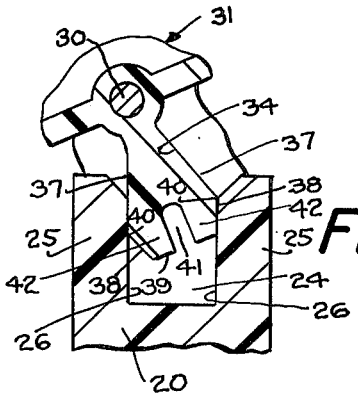
FIG. 4
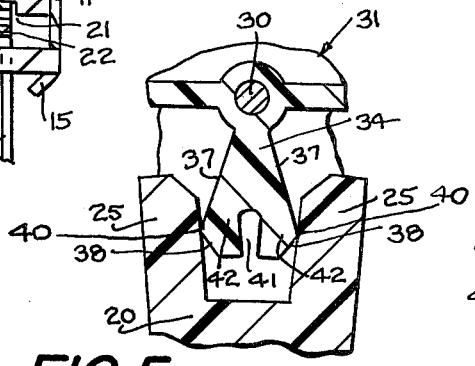
FIG. 5
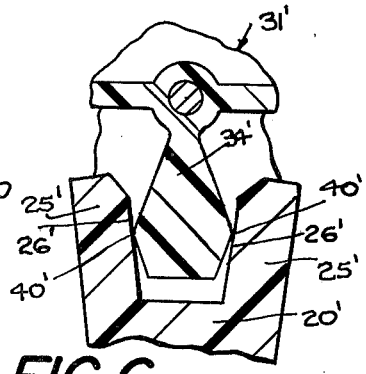
FIG. 6

SNAP-ACTION SLIDE SWITCH

This invention relates generally to electric slide switches and more particularly to an improved construction of a snap action slide switch of the type having a pivoted rocker arm or lever for actuating the same.

Among the principal objects of the present invention is to provide a slide switch in which the contact carrying slide is snapped positively and rapidly into one or the other of its two extreme positions by means of a snap-action toggle connection between a pivoted rocker arm or lever and the actuating knob or button of the switch slide.

Another object is to form the parts which make up the toggle connection of a material such as a moldable plastic, which has the elastical power of recovering its initially produced shape when a deforming force or load causing it to be temporarily deformed is removed.

Still another object is to provide a rocker-arm actuated slide switch with snap action by simple and low cost redesign and modification of the switch slide button and its coacting rocker arm conventionally employed in such rocker type slide switches.

A further object of the invention is to provide a rocker type slide switch with a snap-action movement of its contact-carrying slide part without increasing the number of separate parts ordinarily present in such rocker type slide switches.

A still further and important object of the invention is to provide a snap-action rocker type of slide switch wherein the force which serves to produce the snap movement of the contact-carrying slide of the switch in and of itself does not impose any such load on the slide as would tend to objectionally increase the contact pressure between the fixed and movable contact elements of the slide switch, thereby minimizing any interference with the snap movement of the switch slide to the limit of its travel in either direction as well as premature wear of the contact elements.

Other objects and advantages of the present invention will appear more fully hereinafter, it being understood that the invention consists in the combination, construction, location and relative arrangement of parts, all as described in the following specification, as shown in the accompanying drawings and as finally pointed out in the appended claims.

In the accompanying drawings:

FIG. 1 is a perspective view of a rocker type snap-action slide switch constructed in accordance with and embodying the principles of the present invention;

FIG. 2 is an enlarged longitudinal cross-sectional view of the switch as taken on the line 2—2 of FIG. 1, showing the position assumed by the actuating rocker arm of the switch upon snapping the contact-carrying slide of the switch to the limit of its travel in one direction;

FIG. 3 is a transverse cross-sectional view of the switch as taken on the line 3—3 of FIG. 2;

FIG. 4 is a partial transverse sectional view of the interengaged parts of the switch slide and the rocker arm showing their relative positions when the switch slide is snapped into its endmost position opposite that shown in FIG. 2;

FIG. 5 is a partial sectional view similar to FIG. 4 showing the rocker arm in its unstable dead center position relatively to the switch slide; and FIG. 6 is a partial sectional view similar to FIG. 5 showing a modification of the present invention.

Referring now more particularly to the drawings, it will be noted that while the present invention is shown as being embodied in a slide switch of the basic construction shown in U.S. Pat. No. 3,271,535, it will be understood that the principles of the invention are equally applicable to other constructions of slide switches which include a rectilinearly slidable switch actuator having movable therewith electrical contact members which are adapted to electrically bridge one or more sets of paired relatively fixed contact terminals upon movement of the switch actuator and the contact members carried thereby relatively to the fixed contact terminals.

In the illustrated construction of the slide switch, as best shown in FIGS. 1 to 3, it includes an elongated housing member 10 having parallel side walls 11—11 and a top wall 12 which is provided with an elongated aperture 13 and mounting holes 14—14 for mounting the switch in any suitable manner.

The side walls 11—11 of the switch housing member 10 are each provided with depending integral tabs 15 which are inturned as shown to secure in spaced parallel relation to the apertured top wall 12 an insulating base member or terminal board 16 having fixed therein one or more parallel rows of longitudinally spaced contact elements 17*a*, 17*b* and 17*c*. In the construction shown, the terminal board is provided with two parallel rows of the fixed contact elements and with each row including three such contact elements, thus providing for a 2-pole, 2-position switch, but it will be apparent that the disposition and number of such fixed contacts may be changed depending upon the number of poles and positions desired for any particular switch.

Disposed in the housing between the top wall 12 thereof and its insulating base member 16 is a rectilinearly slidable contact carrying member 18 having a rectangular base portion 19 and an upwardly protruding knob portion 20 which extends through and is movable along the elongated aperture 13 provided in the housing top wall 12. The member 18, of which the knob 20 is an integral part, is formed of any substantially rigid insulation material, such as nylon or other moldable thermosetting or thermoplastic plastic material having the elastical property of being able to immediately recover its initially molded durable shape when it is relieved of a deforming force or pressure causing it to be temporarily deformed.

The slidable member 18 is provided in its bottom surface with one or more longitudinally extending parallel channels 21 within each of which is suitably mounted for rectilinear movement with the member 18 a metal contact shoe 22 of a length sufficient to electrically bridge an adjacent pair of the fixed contact elements 17*a*, 17*b* and 17*c* longitudinally alined in a row underlying the path of a contact shoe 22. Each contact shoe is resiliently biased downwardly from its accomodating channel 21 in the slide member 18 by any suitable means for affecting adequately pressured electrical engagement with its underlying fixed contacts insulatingly secured in the base member 16. Preferably, this spring-pressed bias of the contact shoes is effected by a spring element 23 interposed between each shoe and the base wall of the channel 21 in which it is accomodated, as described in the hereinabove mentioned U.S. Pat. No. 3,271,535.

The upwardly projecting knob 20 of the contact-carrying slide member 18 is transversely slotted or notched, as at 24, to provide a pair of freely extending end wall parts 25—25 having parallel inner faces 26—26 disposed in planes extending transversely of and normal to the direction of movement of the member 18. These end wall parts or lugs 25—25 of the slide member knob 20, which are exposed above the apertured top wall 12 of the switch housing member 10, are inherently sufficiently resilient to permit outward deflection thereof upon application of pressure exerted against their inner faces 26—26 and instant return thereof to their relaxed static condition as shown in FIGS. 2 and 4 upon release of said deflecting pressure.

Secured to the housing member 10 of the switch is a pivot bracket 27 having an apertured base wall 28 and a pair of upstanding parallel side walls 29—29 between which is pivotally mounted, as by a pivot pin 30, a rocker member generally designated 31. The bracket 27 is secured with its base wall closely overlying the top wall 12 of the switch and with its base wall aperture in registry with the aperture 13 of the switch housing member 18 whereby the registering apertures conjointly provide an elongated guide slot for movement therealong of the switch knob 20. Any suitable means may be employed for securing the bracket 27 to the switch housing, preferably as by providing the latter with integral tabs 32 at opposite ends of its aperture 13 adapted to be bent over as shown to clinch the bracket to the switch housing.

The side walls 29—29 of the bracket 27 extend upwardly beyond the upper ends of the lugs 25—25 of the switch knob 20 and have their upper ends apertured to receive the pivot pin 30 about which the rocker member 31 pivots for actuation of the switch.

The rocker member 31, which is basically formed of any suitable plastic material having the same resilient or elastic property as that above described for the material of which the switch slide part 18 is formed, includes a semi-circular part 33 from which centrally depends an integrally formed arm or lever 34. Extending outwardly from the rocker part 33 in axial alinement with its depending arm or lever 34 is an operating handle 35 which may also be formed integral with the part 33 or as a separate element suitably secured thereto.

The depending arm or lever 34 of the rocker member is of a length extending below the pivot 30 sufficient for accomodation of its freely projecting end portion 36 into the recess formed between the spaced lugs 25—25 of the switch slide member 18. As viewed from one end of the recess in which the arm or lever 34 is received, the operative end portion 36 of said lever is generally of a polygonal shape having a pair of opposite downwardly diverging flat end wall surfaces 37—37 respectively terminating in an adjoining pair of opposite downwardly converging flat end wall surfaces 38—38. The bottom end of the lever arm 34 is preferably truncated as at 39. The adjoining flat surfaces 37 and 38 at each of the opposite sides or ends of the rocker arm or lever 34 (as viewed in FIGS. 2, 4 and 5) are so angularly related as to provide at their lines of juncture a pair of oppositely projecting sharply cornered edges 40—40 which respectively bear against the opposed inner faces 26—26 of the flexible lugs 25—25 of the slide switch knob 20.

The truncated bottom end portion of the rocker arm or lever 34 is preferably bifurcated, as at 41, to provide a pair of spaced apart branches 42—42 having the same elastical property as that hereinbefore described for the spaced apart lugs 25—25 of the switch knob 20. It will be noted that in its relaxed, i.e., unstressed, condition of the rocker arm 34, as shown in FIGS. 2 and 4, the flat end wall surface 37 at each side of the rocker arm parallels the flat end wall surface 38 at the opposite side of the arm.

Having described the construction of the switch as shown in FIGS. 1 to 5, its operation is as follows. It will be observed that when the rocker member 31 has been rotated clockwise into its position A shown in FIG. 2, its lever arm 34 in engagement with the knob 20 of the switch slide member 18 will have shifted the latter toward the left into its endmost position wherein the contact shoe or shoes 22 electrically bridge the underlying fixed contact elements **17*b* and 17*c* of the switch. Upon counter-rotation of the rocker member 31 into its position designated C, the switch slide member 18 will be shifted to the right to thereby transfer the contact shoe or shoes 22 into its opposite endmost position for electrically bridging the fixed contact elements 17*b* and 17*a*. The switch slide member 18 will be effectively and positively held against displacement from each of these endmost positions thereof by the flatwise engagement of the flat faces 37 and 38 of the rocker arm lever 34 respectively against the flat inner faces of the lugs 25—25 of the switch knob 20.**

As the rocker member 31 is rotated from its position A to its position C and vice-versa, it passes through a central dead center position B in which the interengaged flexible branches 42—42 of the lever arm 34 of the rocker and the flexible lugs 25—25 of the switch slide knob 20 are deformed, as shown in FIG. 5, by the pressure respectively exerted by the opposite sharply cornered edges 40—40 against the inner faces 26—26 of the knob lugs 25—25. In this deformed condition of the interengaged parts of the pivoted lever arm 34 and the switch slide, the branches 42—42 of the arm 34 are pressed inwardly toward one another simultaneously as the lugs 25—25 of the switch slide knob 20 are pressed apart. This deformation of the interengaged parts results in the storing up of energy which serves when released upon rotation of the rocker member beyond its dead center position B to snap the contact-carrying slide member 18 of the switch to the limit of its travel in either direction with a velocity which is a function primarily of the stored up energy. The velocity of travel of the switch slide member 18 once the rocker member has passed over its dead center is not affected by the continued angular movement of the rocker arm 34 but instead is determined solely by the strength of the energy force which is generated by the inherent power of the flexed parts within the elastic limits thereof to resist their deflection and return to their original durable or relaxed condition.

FIG. 6 illustrates a modified form of the present invention wherein the arm or lever 34' is not bifurcated as in the previously described construction but rather is of solid form throughout. The rocker arm 31' is, however, of the same general external shape as that previously described and is provided with the opposed sharply cornered edges 40'—40' which respectively bear against the opposed inner flat faces 26'—26' of the lugs 25'—25' of the contact-carrying slide member knob 20'. In this embodiment of the invention, the energy for effecting snap-action movement of the switch slide is generated solely by the flexure of the knob lugs as the rocker arm rotates from one or the other of its endmost positions through its central dead center position. Where the energy for effecting the snap-action movement of the switch slide member is derived from the inherent capacity of only the knob lugs to resist outward deflection thereof, as in the modification of FIG. 6, the same degree of snap-action as that obtained when both the knob lugs and the bifurcated parts of the rocker arm are conjointly flexed may be achieved either by changing the position of the cornered edges of the solid lever arm relatively to the inner faces of the knob lugs respectively engaged thereby, by increasing the thickness of the knob lugs to render them more resistant to outward flexure, by forming the switch slide and its slotted knob of a material having the requisite coefficient of elasticity and/or by such other changes in dimension, relative disposition and physical properties of the interengaged parts as may be required to snap the switch slide member to the limit of its travel in either direction and hold it in its selected end position upon overcentering rotation of the rocker member.

It will be understood that the snap action switch construction of the present invention eliminates the need of employing therein any auxiliary detent means, such as the detent plate shown and described in the hereinbefore mentioned U.S. Pat. No. 3,271,535, since the rocker arm in each of its overcentered positions, as see FIGS. 2 and 4, and consequently the switch slide member connected thereto, is firmly and securely held against end play by the interengaged flat surfaces of the rocker arm and its embracing knob lugs. However, the present invention is applicable to and may be embodied in slide switches having such auxiliary detent means.

An important feature and advantage of the present invention is that while it effectively provides a snap action movement to the contact-carrying slidable member of the switch, it does not impose any load upon such member as would tend to unduly increase the contact pressure between the fixed and movable contact elements of the switch, thereby minimizing premature weat of such elements and insuring easy and free snap action movement of the switch slide under control of the rocker arm operatively engaged therewith.

It will be understood that the present invention is subject to various changes and modifications which may be made from time to time without departing from the principles or real spirit thereof and that it is accordingly intended to claim the same broadly, as well as specifically, as indicated by the appended claims.

What is claimed as new and useful is:

1. A snap action slide switch comprising a switch assembly which includes a slidable insulated support mounting an elongated electrical contact movable therewith and a relatively fixed insulated support mounting a plurality of relatively fixed contact terminals spaced along the path of travel of said movable contact in underlying relation thereto, said movable contact being adapted to electrically bridge at least two adjacent ones of said spaced contact terminals upon shifting movement of said contact into one or the other of its endmost positions, and pivoted rocker means operatively associated with said switch assembly for shifting said slidable contact support along its said path of travel, said rocker means including a freely depending lever arm and said slidable contact support having resilient means operatively engaged and adapted to be temporarily flexed by said rocker lever arm when the latter is rocked about its pivot in either direction to move said slidable contact into a position centered between the opposite endmost positions thereof whereby said resilient means upon said temporary flexure thereof under pressure of said rocker lever arm establishes a releasable force for automatically effecting snap action continued movement of said slidable contact beyond its said centered position.

2. A snap action switch as defined in claim 1 wherein said resilient means includes a pair of spaced apart flexible lugs respectively disposed in planes which project upwardly from said slidable contact support and in transversely extending relation to the path of travel of said slidable contact, which said lugs embrace therebetween the free end of said lever arm.

3. A snap action switch as defined in claim 2 wherein said lugs are formed as integral elements of said slidable support.

4. A snap action switch as defined in claim 2 wherein said resilient lugs are formed of a material having a coefficient of elasticity which enables the same to regain their initial unflexed static condition when the deforming force or pressure causing them to be temporarily deformed is removed.

5. A snap action switch as defined in claim 1 wherein said rocker means is pivoted for arcuate movement thereof about a fixed axis which extends transversely across the path of travel of said slidable contact and is disposed above said resilient means in a vertical plane intersecting the midpoint of the permissible travel of said slidable contact.

6. A snap action switch as defined in claim 1 wherein said resilient means includes a pair of spaced apart flexible lugs which have flat inner faces extending transversely of and projecting upwardly from said insulated slidable contact support and wherein said rocker lever arm is provided with a pair of oppositely projecting sharply cornered edges which respectively engage said flat inner faces of said lugs and exert deflecting pressure against the same upon rotation of said lever arm into its centered position.

7. A snap action switch as defined in claim 6 wherein each of said sharply cornered edges is disposed between a pair of angularly related flat surfaces which alternately flatwise engage the inner faces of said lugs when said rocker arm is rotated in one direction or the other out of its dead center position whereby to effectively positively hold the slidable contact in the endmost position into which it is selectively snapped.

8. A snap action switch as defined in claim 2 wherein the free end of said lever arm is bifurcated to provide the same with a pair of flexible extremities which under pressure of said arm against said lugs to effect outward flexure of the latter are simultaneously flexed inwardly to augment said releasable force established for snap action of the switch.

9. A snap action slide switch comprising a switch assembly having a housing which includes therein a pair of relatively shiftable insulated members which respectively support a slidable electrical contact member and a plurality of relatively fixed contact terminals spaced along the path of travel of said slidable contact member in underlying relation thereto, said slidable contact member being adapted to electrically bridge at least two adjacent ones of said spaced contact terminals upon shifting movement of said contact member in either of two opposite directions, the insulated member which supports said slidable contact member having a pair of spaced apart flexible members which project upwardly from the center position of said support through an aperture formed in the top wall of said housing, said flexible members having the elastical capacity of recovering their original durable state when a flexing pressure applied thereto is released, rocker meanns pivotally supported above said housing having a depending lever extending into the space between said upwardly projecting flexible members, said rocker means being oppositely rotatable to swing its said depending lever beyond a dead centered position between said flexible members into either of two opposite overcenter end positions, and means operative when said lever is rotated through its dead center position to exert pressure against and thereby deflect said flexible members against their inherent capacity of resisting such deflection whereby upon continued rotation of said lever arm beyond its dead center position for release of said deflecting pressure the lever arm acts to snap the switch slide member to the limit of its travel in a selected direction.

10. A snap action switch as defined in claim 9 wherein the free end of said lever arm is bifurcated to provide the same with a pair of flexible extremities which under pressure of said arm against said lugs to effect outward flexure of the latter are simultaneously flexed inwardly to augment said releasable force established for snap action of the switch.

11. A snap action switch as defined in claim 9 wherein said flexible members have flat inner faces disposed in planes extending normal to the path of travel of said slidable contact member and wherein said rocker lever arm is provided with a pair of oppositely projecting sharply cornered edges which respectively engage said flat inner faces of said flexible members and exert deflecting pressure against the same upon rotation of said lever arm into its centered position.

12. A snap action switch as defined in claim 11 wherein each of said sharply cornered edges is disposed between a pair of angularly related flat surfaces which alternately flatwise engage the inner faces of said flexible members when said rocker arm is rotated in one direction or the other out of its dead center position whereby to effectively positively hold the slidable contact in the endmost position into which it is selectively snapped.

13. A snap action slide switch comprising a switch assembly having a housing which includes therein a pair of relatively shiftable insulated members which respectively support a slidable electrical contact member and a plurality of relatively fixed contact terminals spaced along the path of travel of said slidable contact member in underlying relation thereto, said slidable contact member being adapted to electrically bridge at least two adjacent ones of said spaced contact terminals upon shifting movement of said contact member in either of two opposite endmost positions, a rocker member pivotally supported above said housing, said support for said slidable contact member and said pivoted rocker being respectively provided with interengaged means which coact upon arcuate rotation of said rocker member about its pivot to shift said slidable member into a selected endmost position thereof, one of said interengaged means being a pair of spaced apart flexible members, having the elastical capacity of recovering their original durable state when a flexing pressure applied thereto is released, and the other being a member disposed between said spaced flexible members for exerting pressure against the latter to thereby deflect the same against their inherent capacity of resisting such deflection whereby, upon continued rotation of said rocker member through and beyond its dead center position for release of said deflecting pressure, said interengaged means coact to snap the switch slide member to the limit of its travel in a selected direction.

14. A snap action switch as defined in claim 13 wherein said flexible members have flat inner faces disposed in planes extending normal to the path of travel of said slidable contact member and wherein said rocker lever arm is provided with a pair of oppositely projecting sharply cornered edges which respectively engage said flat inner faces of said flexible members and exert deflecting pressure against the same upon rotation of said lever arm into its centered position.

15. A snap action switch as defined in claim 13 wherein each of said sharply cornered edges is disposed between a pair of angularly related flat surfaces which alternately flatwise engage the inner faces of said flexible members when said rocker arm is rotated in one direction or the other out of its dead center position whereby to effectively positively hold the slidable contact in the endmost position into which it is selectively snapped.

* * * * *